US006868556B1

(12) United States Patent
Jenkins

(10) Patent No.: US 6,868,556 B1
(45) Date of Patent: Mar. 22, 2005

(54) SHIRT WITH HOOK AND LOOP FASTENERS

(76) Inventor: Elizabeth M. Jenkins, 2024 Mare's Way, Greenville, NC (US) 27858

( * ) Notice: Subject to any disclaimer, the term of this patent is extended or adjusted under 35 U.S.C. 154(b) by 0 days.

(21) Appl. No.: 10/867,707

(22) Filed: Jun. 16, 2004

(51) Int. Cl.[7] ..... A41B 1/00
(52) U.S. Cl. ..... 2/77; 2/96; 2/913
(58) Field of Search ..... 2/913, 114–118, 2/914, 191, 227, 128, 96, 106, 234–236, 919

(56) References Cited

U.S. PATENT DOCUMENTS

| | | | | |
|---|---|---|---|---|
| 4,570,268 A | | 2/1986 | Freeman | |
| 4,718,124 A | | 1/1988 | Sawicki et al. | |
| 4,825,472 A | * | 5/1989 | Garafano | 2/116 |
| 4,939,794 A | | 7/1990 | Arqnson | |
| 5,097,535 A | * | 3/1992 | Dye et al. | 2/69 |
| 5,184,351 A | | 2/1993 | Benstock | |
| 5,564,123 A | | 10/1996 | Grassick | |
| 5,564,126 A | * | 10/1996 | Chou | 2/114 |
| 5,621,917 A | | 4/1997 | Howsden | |
| 5,924,133 A | | 7/1999 | Zapiti | |
| 6,216,271 B1 | | 4/2001 | Chen | |
| 2003/0135910 A1 | | 7/2003 | Young | |

FOREIGN PATENT DOCUMENTS

| | | |
|---|---|---|
| DE | 19918381 | 10/1999 |
| JP | 2000345401 | 12/2000 |

* cited by examiner

*Primary Examiner*—Danny Worrell
(74) *Attorney, Agent, or Firm*—Richard C. Litman

(57) ABSTRACT

The shirt with hook and loop fasteners has a front panel, a rear panel, and a collar portion. The front panel is split, defining an overlap and an underlap. The overlap and underlap are detachably connected together by mating hook and loop fastener segments which are affixed to corresponding positions on an inner face of the overlap and an outer face of the underlap. A series of buttons are affixed to an outer face of the overlap but do not serve as fasteners. A neck button, disposed proximate the top edge of the underlap may be inserted through a buttonhole proximate the top edge of the overlap to hold the collar around the neck of the wearer. Once the overlap and the underlap are connected, the shirt may be worn with the collar open or closed and still resemble a conventional button shirtfront.

7 Claims, 5 Drawing Sheets

SHIRT WITH HOOK AND LOOP FASTENERS

BACKGROUND OF THE INVENTION

1. Field of the Invention

The present invention relates to a shirt with a separable front panel, and more particularly, to a shirt with a front panel having two halves which may be detachably connected by hook and loop fasteners.

2. Description of the Related Art

Most people can easily manipulate fastening devices, such as buttons, snaps, and zippers, to fasten portions of a garment to one another. For individuals who have limited manual dexterity, however, manipulating such fastening devices is difficult and sometimes impossible. Individuals suffering from arthritis, for example, experience a great deal of difficulty in manipulating a series of buttons on a garment.

Some attempts have been made in the past to provide garments that are easier to don and remove than garments with conventional fasteners. For the most part, however, these garments include loose fitting, specialized clothing, such as hospital gowns, which are not appropriate or desirable for individuals who are not restricted to a hospital and who wish to engage in outside activities. Additionally, most disabled individuals wish to live as normal a lifestyle as is permitted by their disability and do not wish to bring attention to their disability by wearing unusual clothing.

U.S. Pat. No. 4,570,268, issued Feb. 18, 1986 to James J. Freeman, discloses a patient's garment which is loose fitting to accommodate a wide range of sizes. The garment has a body portion and sleeves. The body portion includes a main panel and a pair of adjacent side panels. The outer edges of the side panels are joined together in overlapping relationship by a plurality of fasteners. The top of each sleeve is provided with an openable seam having adjacent mating edges which can be held together in overlapping relationship by a plurality of spaced apart hook and loop fasteners.

U.S. Pat. No. 4,939,794, issued Jul. 10, 1990 to H. R. Aronson, discloses adjustable neck and cuff closures for dress shirts. The neck or cuffs of a man's shirt can be closed in an adjustable manner by providing hook and loop fasteners on respective facing portions of a garment. A dress button sewn on an outer surface of a dress shirt portion simulates the appearance of a conventional garment closure button but serves no part in fastening outer and inner garment portions together.

U.S. Pat. No. 5,924,133, issued Jul. 20, 1999 to M. Zapiti, discloses a garment fastening system for use with a pair of pants having a pair of adjoining leg segments joined at a crotch area and a dress shirt. The garment fastening system comprises hook and loop fastener strips secured to each fly flap of a pair of pants. In a dress shirt, the garment fastening system is used to join a pair of adjacent shirt halves, and a pair of shirt sleeves having a cuff opening, wherein the cuff opening consists of a pair of adjacent cuff flaps. The garment fastening system comprises a first set of hook and loop fastener segments sized and shaped to appear as standard buttons cooperatively arranged between the edges of shirt halves, and a second set of hook and loop fastener segments cooperatively arranged between the adjacent cuff flaps.

Japanese Patent No. 2000-345,401, published Dec. 12, 2000, discloses a shirt for lapped front closing with hook and loop fasteners. The shirt has a pair of adjacent first and second front panels. The first front panel has on a front surface, a plurality of stitched buttonhole segments disposed along a vertical edge margin and a button affixed to each stitched buttonhole segment. A series of mating hook and loop patches are disposed on a back surface of the first front panel and a front surface of the second front panel so that the first and second front panels may be releasably fastened together when disposed in overlapping position. While the shirt resembles a conventional shirt when the collar is closed, the hook and loop fastener segments at the neck are clearly visible when the collar is left open.

Other loose fitting or easy to fasten garments are shown in U.S. Pat. No. 4,718,124, issued Jan. 12, 1988 to Sawicki et al. (patient gown); U.S. Pat. No. 5,184,351, issued Feb. 9, 1993 to Benstock (versatile patient gown); U.S. Pat. No. 5,564,123, issued Oct. 15, 1996 to B. Grassick (single piece upper garment for the physically challenged); U.S. Pat. No. 5,621,917, issued Apr. 22, 1997 to S. R. Howsden (infant care garment); U.S. Pat. No. 6,216,271, issued Apr. 17, 2001 to C. Chen (garment for a patient); German Patent No. 19,918,381, published Oct. 28, 1999 (fastener for coats and jackets); and U.S. Patent Publication No. 2003/0135910, published Jul. 24, 2003.

None of the above inventions and patents, taken either singly or in combination, is seen to describe the instant invention as claimed. Thus, a shirt with hook and loop fasteners solving the aforementioned problems is desired.

SUMMARY OF THE INVENTION

The shirt with hook and loop fasteners of the present invention includes a front panel, a rear panel, and a collar portion. The front panel is split, defining an overlap and an underlap. The overlap and underlap are detachably connected together by mating hook and loop fastener segments which are affixed to corresponding positions on an inner face of the overlap and an outer face of the underlap. A series of buttons are affixed to an outer face of the overlap but do not serve as fasteners. Once the overlap and the underlap are connected, the shirt resembles a button front shirt.

A neck button, disposed proximate a top end of the underlap may be inserted through a buttonhole disposed at a corresponding position proximate a top end of the overlap to hold the collar around the neck of the wearer. Since a button, rather than a hook and loop fastener segment is disposed at this position, the shirt may be worn with the collar open or closed and still resemble a conventional button front shirt.

These and other features of the present invention will become readily apparent upon consideration of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
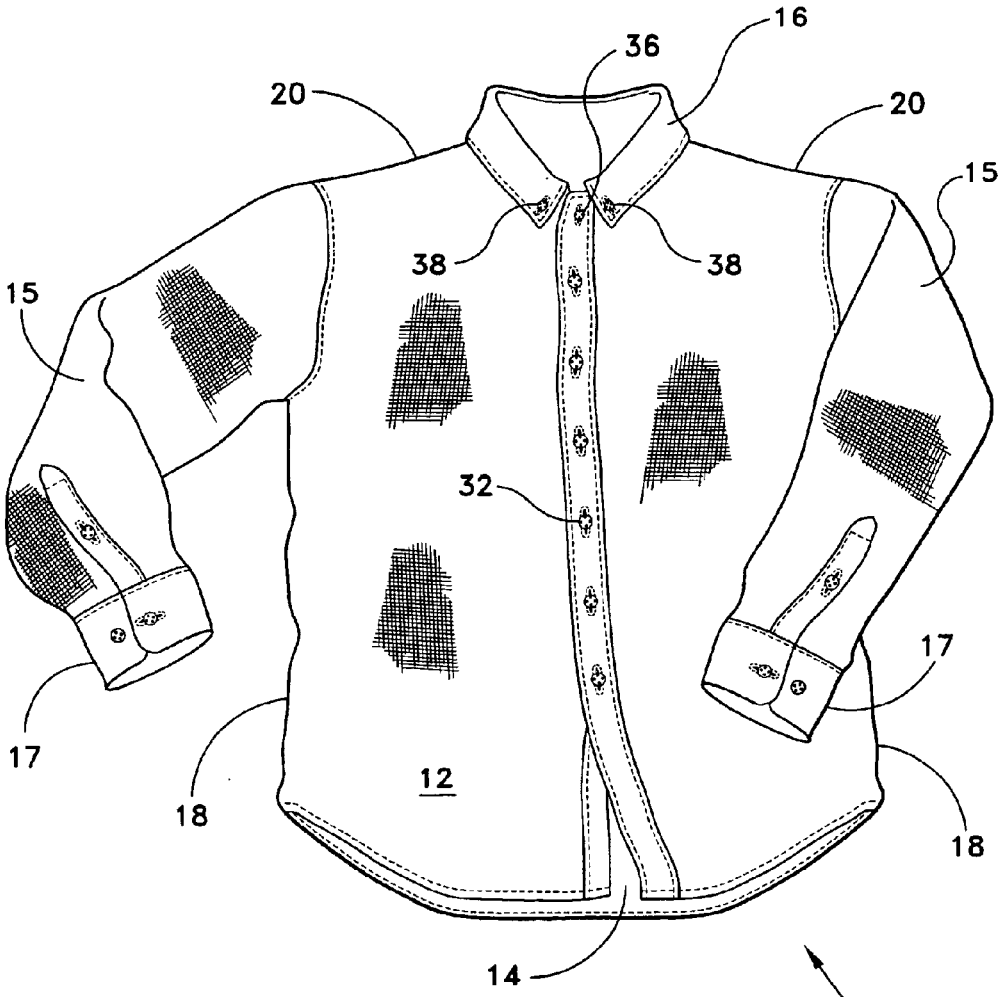
FIG. 1 is an environmental, perspective view of a shirt with hook and loop fasteners according to the present invention.

The present invention relates to a shirt with hook and loop fasteners, generally designated as 10 in the drawings. The shirt 10 includes a front panel 12, a rear panel 14, and a collar portion 16. As with conventional button front shirts, the front and rear panels, 12 and 14, are connected at side seams 18 and shoulder seams 20. The collar portion 16 is connected to the front and rear panels, 12 and 14, between the shoulder seams 20. Sleeves 15 terminating in cuffs 11 may optionally extend between the shoulder seams 20 and the side seams 18. Although long sleeves are depicted in the drawings, the shirt 10 may be a short-sleeved shirt or a sleeveless shirt. The shirt may be a man's shirt or a woman's shirt, e.g., a blouse. The shirt may be made from any suitable fabric, including, but not limited to cotton, wool, and silk.

Figure 2:
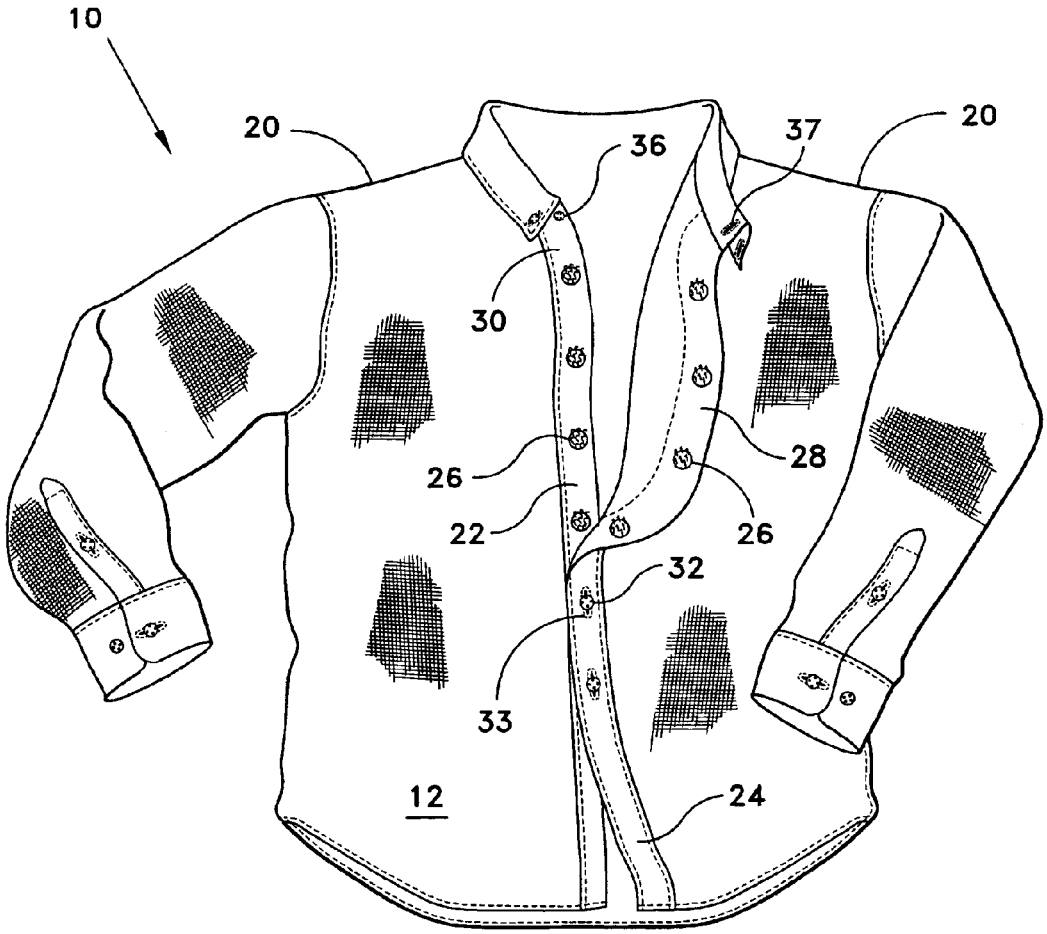
FIG. 2 is a front perspective view of a shirt with hook and loop fasteners according to the present invention, the shirt-front being partially unfastened to show mating hook and loop fasteners on the front panel overlap and the front panel underlap.

Referring to FIG. 2, it can be seen that the front panel 12 is split, defining a shirt underlap 22 and a shirt overlap 24. The underlap 22 and the overlap 24 are detachably connected by mating patches of hook and loop fasteners 26. Preferably, the mating patches of hook and loop fasteners 26 are affixed to corresponding positions of an inner face 28 of the overlap 24 and an outer face 30 of the underlap 22. The mating patches of hook and loop fasteners 26 face and engage each other when the overlap 24 is disposed over the underlap 22. A series of overlap buttons 32 is affixed to an outer face of the overlap 24 but do not serve as fasteners, being primarily for decoration. The overlap 24 may further include stitched portions under each button 32, the stitches forming simulated buttonhole patterns 33 beneath buttons 32, so that the shirtfront simulates the appearance of a conventional buttoned shirt when the hook and loop fasteners 26 are engaged to close the front panel 12.

Figure 3:
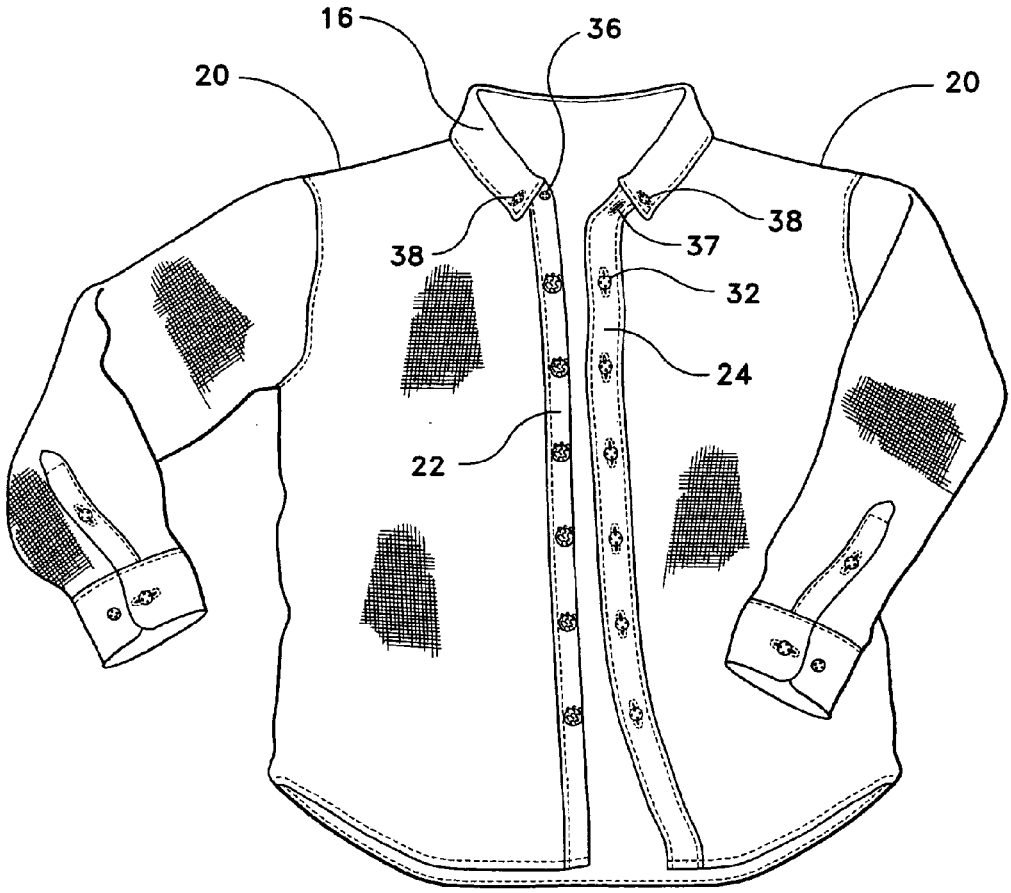
FIG. 3 is a front perspective view of a shirt with hook and loop fasteners according to the present invention, the shirt-front being completely unfastened to show a series of overlap buttons on the outer face of the front panel overlap.
Figure 4:
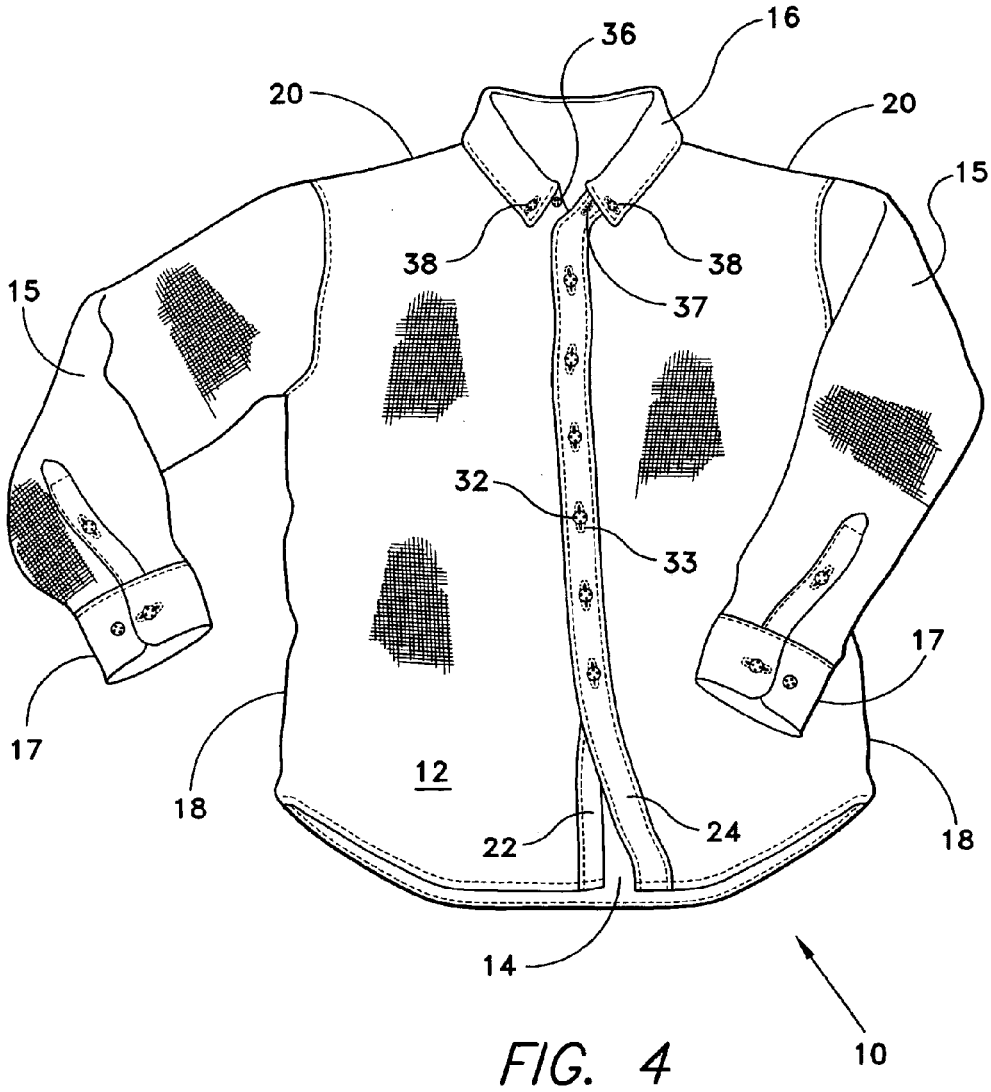
FIG. 4 is a front perspective view of a shirt with hook and loop fasteners according to the present invention, showing the shirt with the collar open.

As shown in FIG. 3, a neck button 36 is disposed proximate the top end of the underlap 22. The neck button 36 may be inserted through a buttonhole 37 in the overlap 24 to secure the collar 16 around the neck of the wearer. Furthermore, collar buttons 38 affixed to the underlap 22 and the overlap 24 may be inserted through corresponding buttonholes in the collar 16 to maintain the collar 16 in position. Alternatively, however, the collar 16 may be left open as shown in FIG. 4. Since the conventional neck button 36, rather than hook and loop fastening material, is disposed at the top end of the underlap 22, the shirt 10 may still resemble a conventional button front shirt even when the collar 16 is left open.

Figure 5:
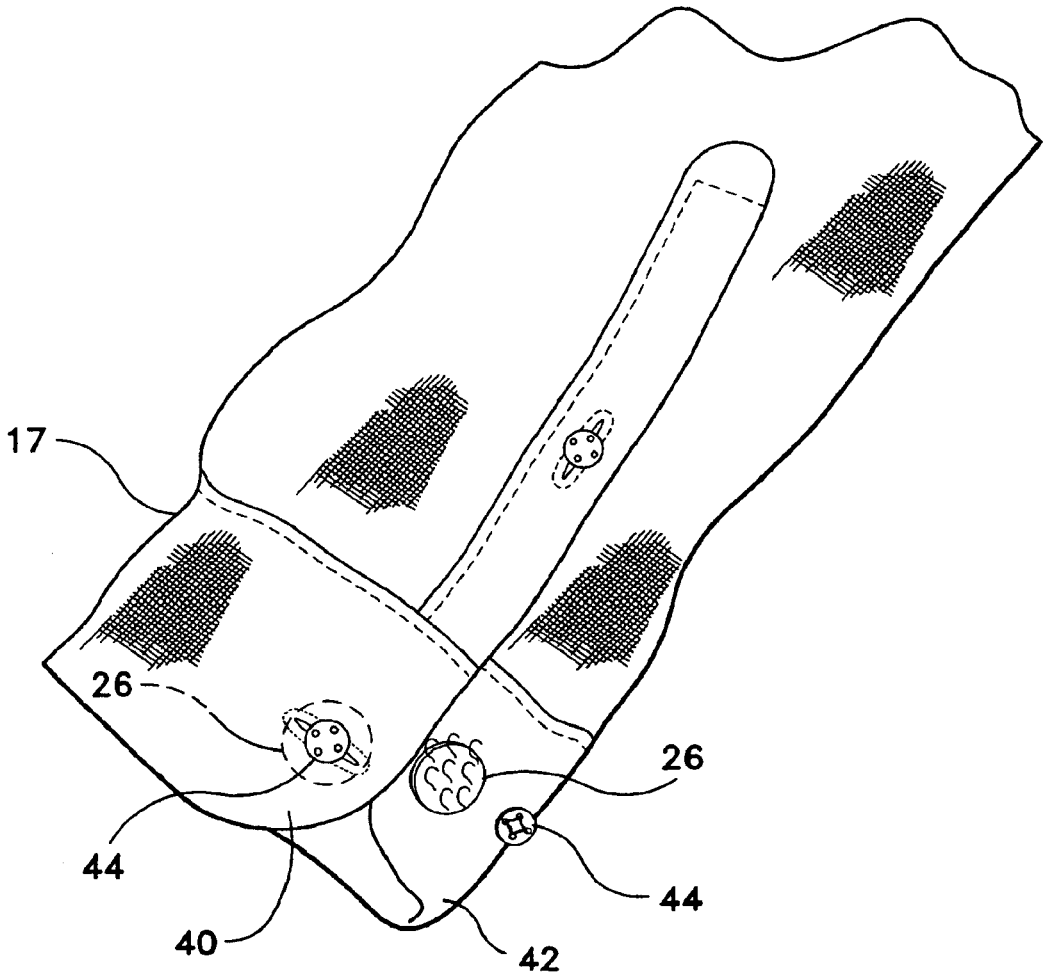
FIG. 5 is a fragmented perspective view showing one sleeve cuff of a shirt with hook and loop fasteners according to the present invention.

As shown in FIG. 5, the sleeve cuffs 17 include a cuff overlap 40 and a cuff underlap 42. A cuff button 44 is disposed on an outer face of the cuff overlap 40 and a hook and loop fastener segment 26 is disposed at a corresponding position on an inner face of the cuff overlap 40. A mating segment of hook and loop fastening material 26 is disposed on an outer face of the cuff underlap 42 for detachably connecting the cuff overlap 40 and the cuff underlap 42.

It is to be understood that the present invention is not limited to the embodiment described above, but encompasses any and all embodiments within the scope of the following claims.

I claim:

1. A shirt with hook and loop fasteners, comprising:

a front panel, the front panel being split, having a front panel overlap and a front panel underlap, the underlap being detachably connected to the overlap, the front panel having a top edge and a pair of opposing side edges, the overlap and the underlap each having an outer face and an inner face, the overlap having a neck buttonhole defined therein;

a rear panel having a top edge and a pair of opposing side edges;

a pair of shoulder seams joining the rear panel top edge and the front panel top edge;

a pair of side seams joining the rear panel side edges and the front panel side edges;

a collar connected to and extending between the shoulder seams;

a plurality of mating hook and loop fasteners disposed along the inner face of the overlap and along the outer face of the underlap;

a plurality of buttons disposed along the outer face of the overlap; and a neck button disposed on the outer face of the underlap for insertion through the neck buttonhole defined in the overlap;

whereby the overlap and the underlap may be detachably connected by joining the mating hook and loop fasteners disposed on the overlap and the underlap to form a closed shirtfront simulating a buttoned shirt.

2. The shirt with hook and loop fasteners according to claim 1, further comprising a pair of sleeves attached to and extending from said shoulder seams and said side seams.

3. The shirt according to claim 2, wherein each said sleeve further comprises:

a sleeve cuff, each of the sleeve cuffs including a cuff overlap having an outer face and an inner face and a cuff underlap having an outer face and an inner face;

a cuff button on the outer face of the cuff overlap; and mating hook and loop fastener segments on the cuff overlap inner face and the cuff underlap outer face.

4. The shirt according to claim 1, wherein said front panel overlap and said front panel underlap each further include a collar button for insertion through a corresponding buttonhole in said collar.

5. The shirt according to claim 1, wherein said shirt is made from cotton.

6. The shirt according to claim 1, wherein said shirt is made from wool.

7. The shirt according to claim 1, wherein said shirt is made from silk.

* * * * *